US008086116B2

(12) United States Patent
Hamaya

(10) Patent No.: US 8,086,116 B2
(45) Date of Patent: Dec. 27, 2011

(54) IMAGE FORMING APPARATUS HAVING PHOTOSENSITIVE MEMBER MOUNTED IN PROCESS CARTRIDGE

(75) Inventor: Masahito Hamaya, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 322 days.

(21) Appl. No.: 12/411,897

(22) Filed: Mar. 26, 2009

(65) Prior Publication Data

US 2009/0245817 A1 Oct. 1, 2009

(30) Foreign Application Priority Data

Mar. 31, 2008 (JP) ..... 2008-090624

(51) Int. Cl.
*G03G 15/00* (2006.01)
*G03G 15/01* (2006.01)
*G03G 21/00* (2006.01)

(52) U.S. Cl. ..... 399/13; 399/110; 399/112

(58) Field of Classification Search ..... 399/13, 399/110, 111, 112
See application file for complete search history.

(56) References Cited

U.S. PATENT DOCUMENTS 6,459,868 B1 * 10/2002 Takahashi et al. ..... 399/110
7,853,158 B2 * 12/2010 Mikuni ..... 399/111 X

FOREIGN PATENT DOCUMENTS

JP 63-301077 A * 12/1988
JP 3-206477 A 9/1991
JP 06-317958 11/1994
JP 6-337555 A 12/1994
JP 10-149059 6/1998

OTHER PUBLICATIONS

Machine translation of JP 06-337555 A dated Apr. 15, 2011.*
JP Office Action dtd Feb. 9, 2010, JP Appln. 2008-090624, partial English translation.

* cited by examiner

*Primary Examiner* — Sophia S Chen
(74) *Attorney, Agent, or Firm* — Banner & Witcoff, Ltd.

(57) ABSTRACT

An image forming apparatus has: an image forming unit which is configured to scan a laser beam in a main scanning direction to expose a photosensitive member, and which forms an electrostatic latent image on the photosensitive member to form an image; a process cartridge that is detachably mounted within the image forming apparatus, the process cartridge holding the photosensitive member on which the electrostatic latent image is formed, and configured to develop the electrostatic latent image by supplying toner to the electrostatic image; and an origin detection unit that is provided on the process cartridge in a position lying within a range of an optical path of the laser beam and out of a range of an optical path of the laser beam for forming the electrostatic latent image, the origin detection unit configured to detect an origin of the laser beam for scanning and exposing.

4 Claims, 12 Drawing Sheets

IMAGE FORMING APPARATUS HAVING PHOTOSENSITIVE MEMBER MOUNTED IN PROCESS CARTRIDGE

CROSS REFERENCE TO RELATED APPLICATION

The present application claims priority from Japanese Patent Application No. 2008-090624, which was filed on Mar. 31, 2008, the disclosure of which is herein incorporated by reference in its entirety.

TECHNICAL FIELD

Apparatus consistent with the present invention relates to an image forming apparatus which is configured to scan a laser beam in a main scanning direction to expose a photosensitive member, and which forms an electrostatic image on the photosensitive member to form an image. More particularly, the present invention relate to an image forming apparatus in which the photosensitive member is mounted in a process cartridge so that the photosensitive member can be replaced together with the process cartridge.

BACKGROUND

Japanese unexamined patent application publication No. JP-A-H10-149059 describes a related art image forming apparatus. The related art image forming apparatus is configured to scan a laser beam in a main scanning direction so as to expose a photosensitive member, and forms an electrostatic image on the photosensitive member to form an image. In the related art image forming apparatus, the photosensitive member is mounted in a process cartridge so that the photosensitive member can be replaced together with the process cartridge. In the related art image forming apparatus, the quality of images can be maintained by replacing process cartridges according to their service lives. However, the related art image forming apparatus cannot form an image under an uncompleted attachment condition as in which the attachment of the process cartridge is forgotten. In addition, although the related art image forming apparatus can be modified to form a multi-color image, the color type related art image forming apparatus cannot form an image in desired colors under an erroneous attachment condition in which an error is made in arranging process cartridges provided color by color in their proper position.

Therefore, the related art image forming apparatus has a shutter which is opened and closed by attachment and detachment of a process cartridge in an optical path directed to a so-called BD sensor for detecting a scanning origin of a laser beam which is scanned described above. In this case, it is presumed that the process cartridge is not attached when the shutter is closed so that the laser beam cannot be detected by the BD sensor, and the relate art image forming apparatus does an appropriate process such as displaying an error message.

SUMMARY

The related art image forming apparatus has a few disadvantages. For example, it is necessary to provide the shutter for determining whether or not the process cartridge is mounted, and the number of components of the image forming apparatus increases, resulting in an increase in production cost thereof. Then, it is an aspect of the invention to provide an image forming apparatus which can properly detect an uncompleted attachment or erroneous attachment of a process cartridge with little increase in the number of components involved therein.

Exemplary embodiments of the present invention address the above disadvantages and other disadvantages not described above. However, the preset invention is not required to overcome the disadvantages described above, and thus, an exemplary embodiment of the present invention may not overcome any of the problems described above.

According to an exemplary embodiment of the present invention, there is provided an image forming apparatus comprising: an image forming unit which is configured to scan a laser beam in a main scanning direction to expose a photosensitive member, and which forms an electrostatic latent image on the photosensitive member to form an image; a process cartridge that is detachably mounted within the image forming apparatus, the process cartridge holding the photosensitive member on which the electrostatic latent image is formed, and configured to develop the electrostatic latent image by supplying toner to the electrostatic image; and an origin detection unit that is provided on the process cartridge in a position lying within a range of an optical path of the laser beam and out of a range of an optical path of the laser beam for forming the electrostatic latent image, the origin detection unit configured to detect an origin of the laser beam for scanning and exposing.

According to the above, the process cartridge holds the photosensitive member which is scanned by the laser beam for exposure and develops the electrostatic latent image formed on the surface thereof with toner. In addition, the origin detection unit for detecting the laser beam at the scanning origin of the scanning exposure is provided on the process cartridge. Because of this, it is found when the laser beam cannot be detected by the origin detection unit that the process cartridge has not possibly been attached yet.

Moreover, this origin detection unit is provided within the range of the optical path of the laser beam and out of the range of the optical path of the laser beam for forming the electrostatic latent image on the photosensitive member. Because of this, there is caused no problem in forming an image by disposition of the origin detection unit on the process cartridge.

In this way, in the image forming apparatus of the aspect of the invention, the possibility of uncompleted attachment of the process cartridge can be detected only by changing the arrangement of the origin detection unit which has conventionally be considered as inevitable without increasing the number of components. Consequently, an appropriate action can be taken to cope with the uncompleted attachment of the process cartridge without increasing the production cost of the image forming apparatus.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

1. First Exemplary Embodiment

Figure 1:
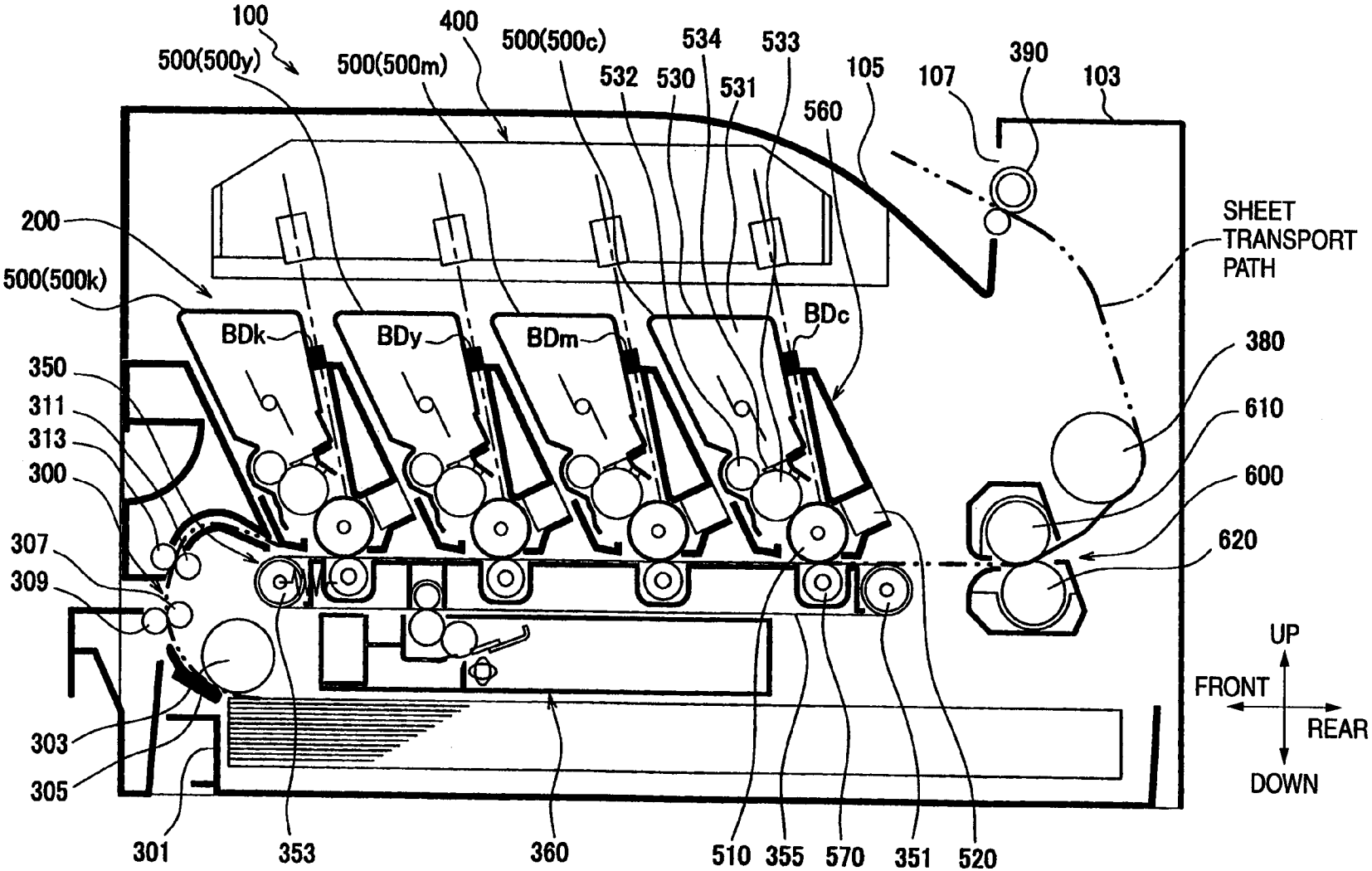
FIG. 1 is a side sectional view showing a schematic configuration of a laser printer of a first exemplary embodiment.

Next, an exemplary embodiment of the invention will be described together with the accompanying drawings. FIG. 1 is a side sectional view showing a schematic configuration of a laser printer 100 as an image forming apparatus of a first exemplary embodiment. Note that in the following description, the left-hand side in FIG. 1 is referred to as front.

1.1 External Configuration of Laser Printer

A housing 103 of the laser printer 100 has a substantially box shape (a cubical shape). A sheet discharging tray 105, on which a recording medium (hereinafter, referred to simply as a sheet) such as a sheet having an image thereon or OHP sheet which are discharged from the housing 103 is placed, is provided on an upper surface of the housing 103.

2. Interior Configuration of Laser Printer

An image forming unit 200 is configured to form an image on a sheet, a feeding unit 300 is a part of a transport unit for transporting a sheet to the image forming unit 200 in cooperation with a transport mechanism 350, and the transport mechanism 350 is the transport unit for transporting a sheet to four process cartridges 500*k*, 500*y*, 500*m*, 500*c* which constitute the image forming unit 200.

In addition, a sheet on which image formation has been completed by the image forming unit 200 is turned about 180° upwards with respect to its transport direction by an intermediate transport roller 380 and a discharge chute and is thereafter discharged onto a sheet discharging tray 105 from a discharging unit 107 by a discharge roller 390.

1.2.1 Feeding Unit

The feeding unit 300 has a sheet feeding tray 301 which is housed at a lowermost part of the housing 103, a feed roller 303 provided in a front upper position in the sheet transport direction on a portion which corresponds to an end portion of the sheet feeding tray 301 for feeding (transporting) sheets placed on the sheet feeding tray 301 sheet by sheet to the image forming unit 200, and a separation pad 305 for imparting transport resistance to a sheet fed out by the feed roller 303 to ensure that only one sheet is fed for further transportation. In addition, sheets stacked in the sheet feeding tray 301 are turned to the front in a U-shaped course within the housing 103 so as to be transported sheet by sheet to the image forming unit 200 provided at a substantially central portion in the housing 103.

In addition, in a transport path reaching from the sheet feeding tray 301 to the image forming unit 200, a transport roller 307 for imparting a transporting force to a sheet which is being transported towards the image forming unit 200 while being curved into a substantially U-shape is provided in a location which turns into a substantially U-shape, while a pressing roller 309 for pressing the sheet towards the transport roller 307 side is provided in a location which confronts the transport roller 307 across the sheet. Additionally, the pressing roller 309 is pressed towards the transport roller 307 side by an elastic device such as a coil spring.

Further, a registration roller 311 is provided further downstream of the transport roller 307 in the sheet transport direction so as not only to contact a leading end of the sheet that is being transported by the transport roller 307 to thereby correct the crooked feeding or traveling of the sheet but also to thereafter transport further the sheet towards the image forming unit 200, and a registration roll 313 is provided so as to confront the registration roller 311. In addition, the registration roll 313 is pressed towards the registration roller 311 side by an elastic device such as a coil spring.

1.2.2 Transport Mechanism

The transport mechanism 350 includes a drive roller 351 which is linked with the image forming unit 200 so as to rotate when the image forming unit 200 is put into operation, a driven or idler roller 353 which is provided rotatably in a position which is spaced apart from the drive roller 351, and a transport belt 355 which is looped round the drive roller 351 and the idler roller 353 so as to extend therebetween. In addition, by the transport belt 355 being rotated with a sheet which has been transported thereonto from the sheet feeding tray 301 resting thereon, the sheet transported from the sheet feeding tray 301 is transported in a front-rear direction of the laser printer 100 so as to be transported sequentially under the four process cartridges 500*k*, 500*y*, 500*m*, 500*c*. In this exemplary embodiment, a belt clear unit 360 is provided under the transport mechanism 350 for removing waste toner sticking to the surface of the transport belt 355.

1.2.3 Image Forming Unit

The image forming unit 200 has a scanner unit 400, the process cartridge 500 and a fixing unit 600. The image forming unit 200 according to this exemplary embodiment is an image forming unit of so-called direct tandem type which can make color prints. In addition, in this exemplary embodiment, the four process cartridges 500*k*, 500*y*, 500*m*, 500*c* are provided to be aligned in series along the sheet transport direction so as to correspond to toner (developer) of four colors such as black (K), yellow (Y), magenta (M) and cyan (C) sequentially in that order from an upstream side of the sheet transport direction. The four process cartridges 500*k*, 500*y*, 500*m*, 500*c* have the same construction except that they hold toner of different colors. Then, hereinafter, the four process cartridges 500*k* 500*y*, 500*m*, 500*c* are referred to as the process cartridge 500 as a whole.

1.2.3.1 Process Cartridge

As shown in FIG. 1, the process cartridge 500 houses therein a photosensitive drum 510 which is an example of a photosensitive member, a charger 520 and a toner accommodation portion 530 and is housed in a drawer unit 560 which can be drawn out of the housing 103.

In addition, a transfer roller 570 is supported rotatably on a body frame on an opposite side to the photosensitive drum 510 across the transfer belt 355. In addition, in this exemplary embodiment, the four process cartridges 500*k*, 500*y*, 500*m*, 500*c* are housed in a single drawer unit 560, and hence, these four process cartridges 500*k*, 500*y*, 500*m*, 500*c* are attached to and detached from the body frame altogether.

Additionally, the photosensitive drum 510 constitutes a photosensitive member which carries thereon an image which is to be transferred onto a sheet and has a cylindrical shape whose uppermost surface is formed of a positively chargeable photosensitive layer made up of polycarbonate or the like.

The charger 520 constitutes a charging unit for charging the surface of the photosensitive drum 510 and is provided in a rear, obliquely upper position relative to the photosensitive drum 510 so to confront and be spaced a predetermined interval apart from the photosensitive drum 510 so as not to be brought into contact therewith. In addition, the charger 520 according to this exemplary embodiment adopts a scorotron-type charger for charging substantially uniformly the surface of the photosensitive drum 510 with positive electric charge by implementing a corona discharge thereonto.

The transfer roller 570 is provided so as to confront the photosensitive drum 510 and is linked with the transport belt 355 so as to rotate in association with rotation or cyclic running of the transport belt 355. The transfer roller 570 constitutes a transfer unit for transferring toner sticking to the surface of the photosensitive drum 510 to a printing surface of a sheet when the sheet is passing by the photosensitive drum 510 by applying opposite electric charge to the electric charge with which the photosensitive drum 510 is electrified (negative electric charge in this exemplary embodiment) to the sheet from an opposite side to the side where the printing surface is configured.

The toner accommodation portion 530 has a toner accommodation chamber 531 in which toner is accommodated, a toner supply roller 532 for supplying toner to the photosensitive drum 510 and a developing roller 533. The toner accommodation portion 530 according to this exemplary embodiment is attached to and detached from a main body of the process cartridge 500.

In addition, toner accommodated in the toner accommodation chamber 531 is supplied to the developing roller 533 side by rotation of the toner supply roller 532. Further, the toner supplied to the developing roller 533 side is carried on a surface of the developing roller 533 and the thickness of toner so carried is regulated to become constant (uniform) at a predetermined thickness by a layer thickness regulating blade 534. Thereafter, the toner is then supplied to the surface of the photosensitive drum 510 which is exposed by the scanner unit 400. Namely, the positively charged toner is caused to stick to an electrostatic latent image on the photosensitive drum 510 whose electric potential is lowered by the exposure to thereby develop the electrostatic latent image.

1.2.3.2 Fixing Unit

The fixing unit 600 is provided further downstream than the photosensitive drum 510 in the sheet transport direction for thermally fixing the toner transferred onto the sheet. Specifically, the fixing unit 600 includes a heating roller 610 which is provided on the printing surface side of the sheet for imparting a transporting force to the sheet while heating the toner thereon and a pressing roller 620 which is provided on an opposite side of the sheet to the side where the heating roller 610 is provided across the sheet for pressing the sheet towards the heating roller 610 side. In addition, the heating roller 610 is driven to rotate in synchronism with the developing roller 533 and the transport belt 355. On the other hand, the pressing roller 620 receives a rotating force from the heating roller 610 via the sheet which is in contact with the heating roller 610 so as to be driven idly.

1.2.3.3 Scanner Unit

Figure 2A:
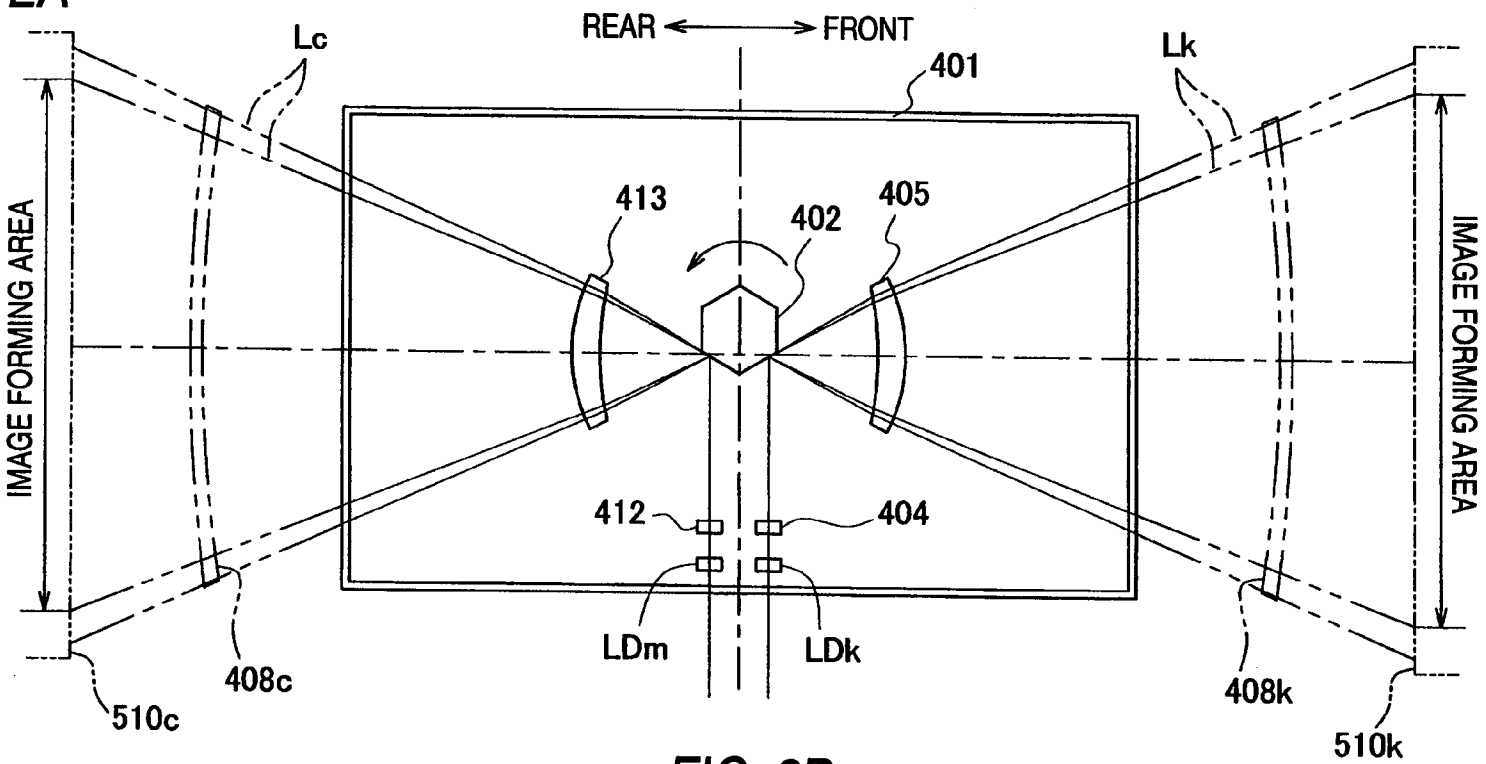
FIG. 2A is a plan view showing a schematic configuration of a scanner unit of the laser printer.
Figure 2B:
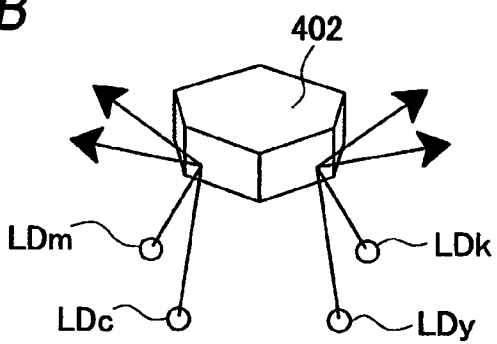
FIG. 2B is a diagram showing laser beams which are deflected by a polygon mirror.
Figure 3:
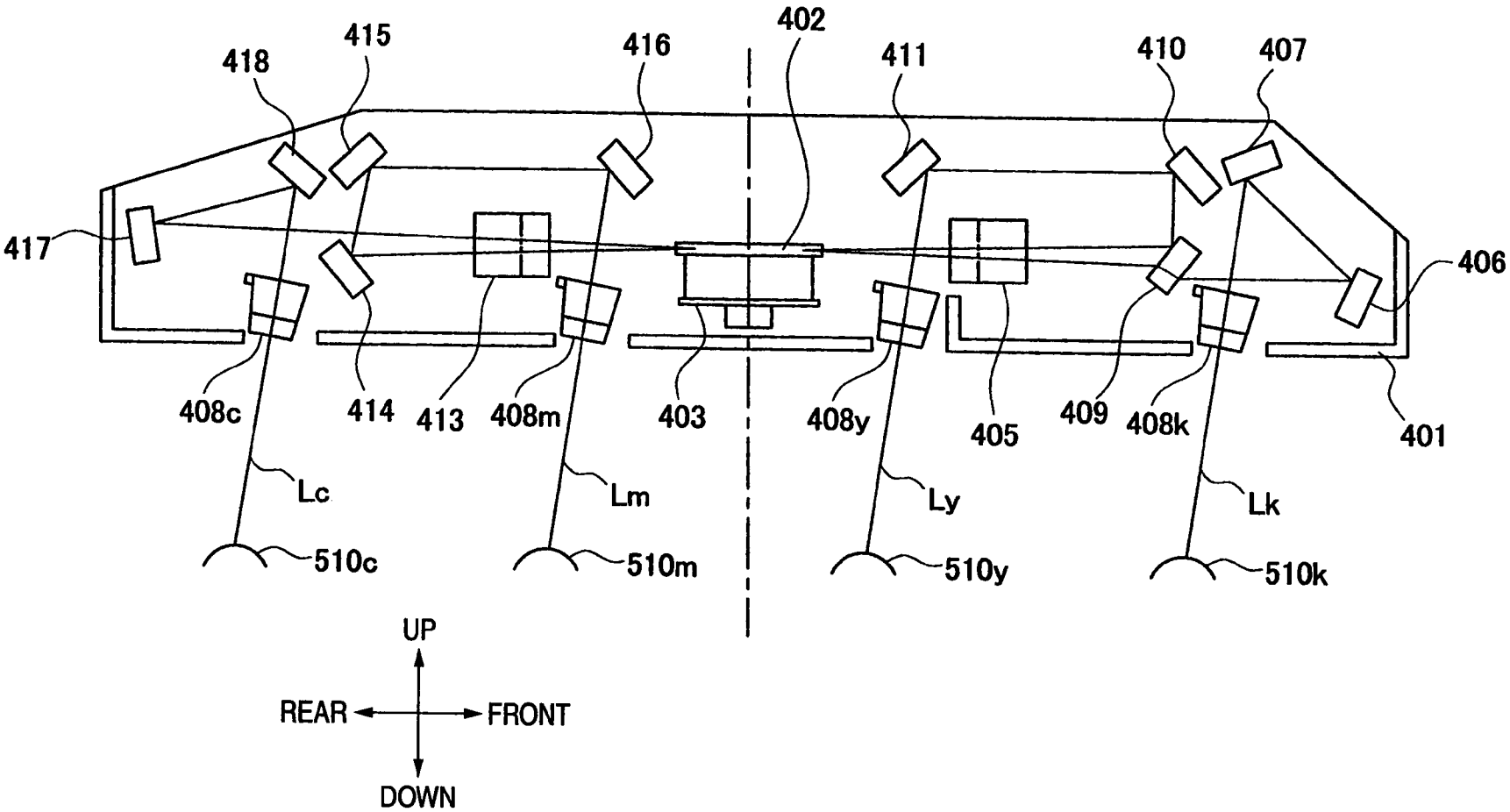
FIG. 3 is a sectional view showing the configuration of the scanner unit.

FIG. 2A is a plan view showing a schematic configuration of the scanner unit 400, FIG. 2B is a diagram showing laser beams which are deflected by a polygon mirror 402, and FIG. 3 is a sectional view showing the configuration of the scanner unit 400.

Since reflecting mirrors are omitted in FIG. 2A, optical paths of laser beams Lk and laser beams Lc are shown as deployed optical paths in which fold-back optical paths generated by the reflecting mirrors are omitted, and the optical paths shown are equivalent to optical paths shown in FIG. 3.

The scanner unit 400 is an exposing unit for exposing the surface of the photosensitive drum 510 by emitting a laser beam onto the photosensitive drum 510 so as to form an electrostatic latent image on the photosensitive drum 510. In addition, as shown in FIG. 2, a plurality of (four in the embodiment) laser diodes LDk, LDc, LDm, LDy (hereinafter, when these diodes are referred to as a whole, they are referred to as a laser diode LD) are provided within a casing 401 of the scanner unit 400. The polygon mirror 402 is provided substantially in a center of the housing which constitutes a deflecting and scanning unit for deflecting and scanning a laser beam emitted from the laser diode LD.

In addition, the polygon mirror 402 is a rotating polygon mirror which is driven to rotate by a polygon motor 403 (refer to FIG. 3), and the laser diode LD is a semiconductor laser which oscillates to emit a laser beam when energized with an electric current which is equal to or larger than a threshold.

Incidentally, the laser diode LDk and the laser diode LDm are provided in positions where they emit laser beams to the polygon mirror 402 from obliquely upper positions relative to a flat plane (a horizontal plane) which is vertical to reflecting surfaces of the polygon mirror 402, while the laser diode LDc and the laser diode LDy are provided in positions where they emit laser beams to the polygon mirror 402 from obliquely downward positions relative to the horizontal plane.

In addition, the laser diode LDk is a member that emits a laser beam for forming a black electrostatic latent image, and a laser beam Lk which is emitted from the laser diode LDk reaches the polygon mirror 402 via a cylindrical lens 404.

The laser beam LDk which is deflected by the polygon mirror 402 is, as shown in FIG. 3, guided to the front side of the laser beam, passes through an fθ lens 405 and is folded back to the rear by a reflecting mirror 406. Thereafter, the laser beam Lk is folded downwards by a reflecting mirror 407, passes through a toric lens 408*k* and is emitted onto the surface of the black photosensitive drum 510*k*. As this occurs, since the polygon mirror 402 is rotating, the laser beam Lk is scanned on the surface of the photosensitive drum 510*k* at high speed from one end side to the other end side in the longitudinal direction of the photosensitive drum 510*k* (from a lower side to an upper side in FIG. 2A).

In addition, the laser diode LDy is a member to emit a laser beam for forming a yellow electrostatic latent image, and a laser beam Ly which is emitted from the laser diode LDy reaches the polygon mirror 402 via a cylindrical lens 404.

Then, the laser beam Ly is deflected and scanned by the polygon mirror 402 so as to pass through the fθ lens 405 and is then folded back to the rear by reflecting mirrors 409, 410. Further, the laser beam Ly is folded back downwards by a reflecting mirror 411, thereafter passes through a toric lens 408*y* and is emitted onto the surface of the yellow photosensitive drum 510*y* while being scanned at high speeds.

In addition, the laser diode LDm is a member to emit a laser beam for forming a magenta electrostatic latent image, and a laser beam Lm which is emitted from the laser diode LDm is deflected reaches the polygon mirror 402 via a cylindrical lens 412. Then, the laser beam Lm is deflected by the polygon mirror 402 so as to be guided to the rear side of the laser printer 100, which is a reverse direction to the direction in which the laser beams Lk, Ly are guided, passes through a fθ lens 413 and is then folded back to the front by reflecting mirrors 414, 415. Thereafter, the laser beam Lm is folded back downwards by a reflecting mirror 416, passes through a toric lens 408*m* and is then emitted onto the surface of the photosensitive drum 510*m*. As this occurs, since the polygon mirror 402 is rotating, the laser beam Lm is scanned on the surface of the photosensitive drum 510*m* at high speed from one end side to the other end side in the longitudinal direction of the photosensitive drum 510*y* (from an upper side to a lower side in FIG. 2A).

In addition, the laser diode LDc is a member to emit a laser beam for forming a cyan electrostatic latent image, and a laser beam Lc which is emitted from the laser diode LDc reaches the polygon mirror 402 via the cylindrical lens 412. Then, the laser beam Lc is deflected and scanned by the polygon mirror 402 so as to pass through the fθ lens 413 and is then folded back to the front by a reflecting mirror 417. Further, the laser beam Lc is folded back downwards by a reflecting mirror 418, thereafter passes through a toric lens 408c and is emitted onto the surface of the yellow photosensitive drum 510*c* while being scanned at high speeds.

Figure 4:
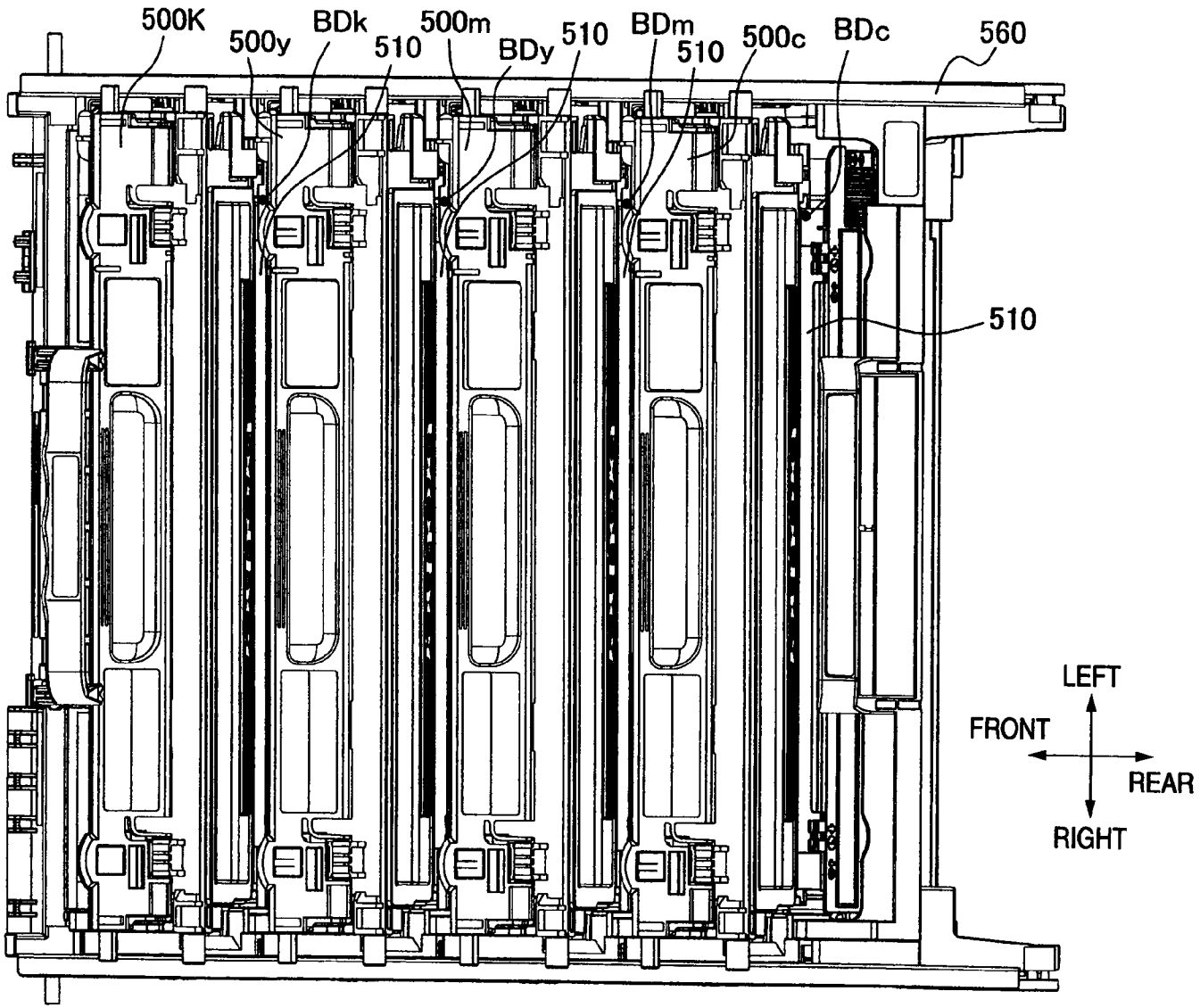
FIG. 4 is a plan view showing the configuration of process cartridges which are housed in a drawer unit of the laser printer.

In addition, in this exemplary embodiment, BD (Beam Detect) sensors BDk, BDy, BDm, BDc, which are an example of an origin detection unit for detecting each of the laser beams Lk, Ly, Lm, Lc at a deflection and scan starting position (a scan origin), are provided in the following positions. FIG. 4 is a plan view showing configurations of the four process cartridges 500*k*, 500*y*, 500*m*, 500*c* which are housed in the drawer unit 560.

As shown in FIG. 4, the black BD sensor BDk is fixed to a left-hand side of an exposed portion of the photosensitive drum 510 of the black process cartridge 500*k*. Namely, the BD sensor BDk is provided within a range of an optical path of the laser beam Lk and in a position where the BD sensor BDk does not affect the formation of an electrostatic latent image onto the photosensitive drum 510. In addition, since the BD sensor BDk is fixed to the process cartridge 500, the BD sensor BDk is attached to and detached from the drawer unit 560 together with the process cartridge 500*k*. Similarly, the BD sensors BDy, BDm, BDc for yellow, magenta and cyan are also fixed to left-hand sides of exposed portions of the photosensitive drums 510 of the process cartridges 500*y*, 500*m*, 500*c* and are attached to and detached from the drawer unit 560 together with the process cartridges 500*y*, 500*m*, 500*c*. In addition, as shown in FIG. 1, each BD sensor BD is provided further upwards than the photosensitive drums 510.

1.3 Configuration of Control System of Laser Printer

Figure 5:
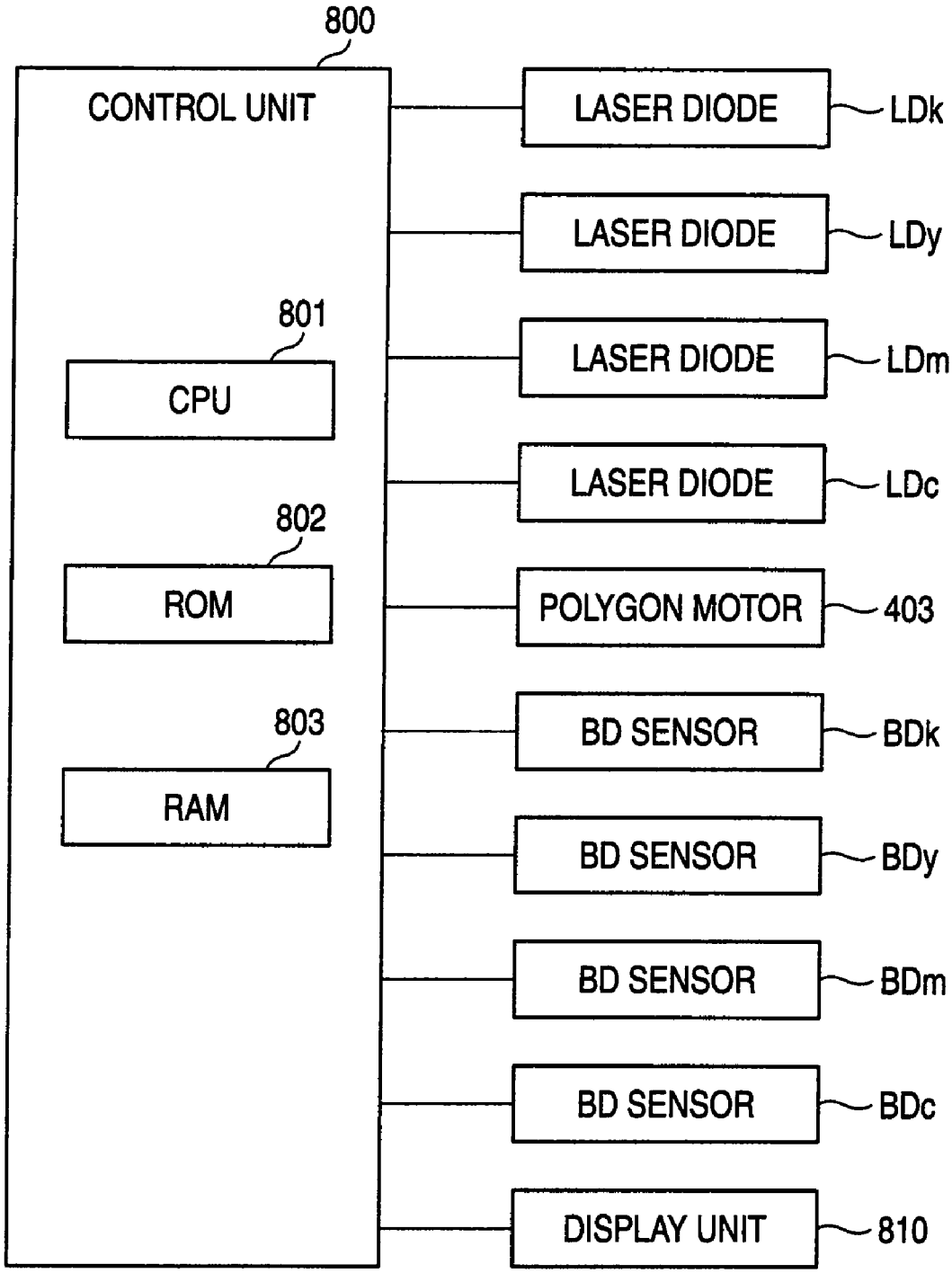
FIG. 5 is a block diagram showing the configuration of a control system of the laser printer.

Next, FIG. 5 is a block diagram showing the configuration of a control system of the laser printer 100 which is configured as has been described heretofore. As shown in FIG. 5, the laser diodes LDk, LDy, LDm, LDc, the polygon motor 403 and the BD sensors BDk, BDy, BDm, BDc are connected to a control unit 800 together with a display unit 810. In addition, the display unit 810 is provided on a front surface of the housing 103. The control unit 800 has a microcomputer including a CPU 801, a ROM 802 and a RAM 803 and executes the following controls based on programs stored in the ROM 802.

1.4 Controls by Control System

Next, controls to be executed by the control unit 800 will be described. The CPU 801 executes a detection sequence operation as shown in FIG. 6 based on a program stored in the ROM 802 at predetermined timings such as those when a power supply is introduced or when a cover is closed.

Figure 6:
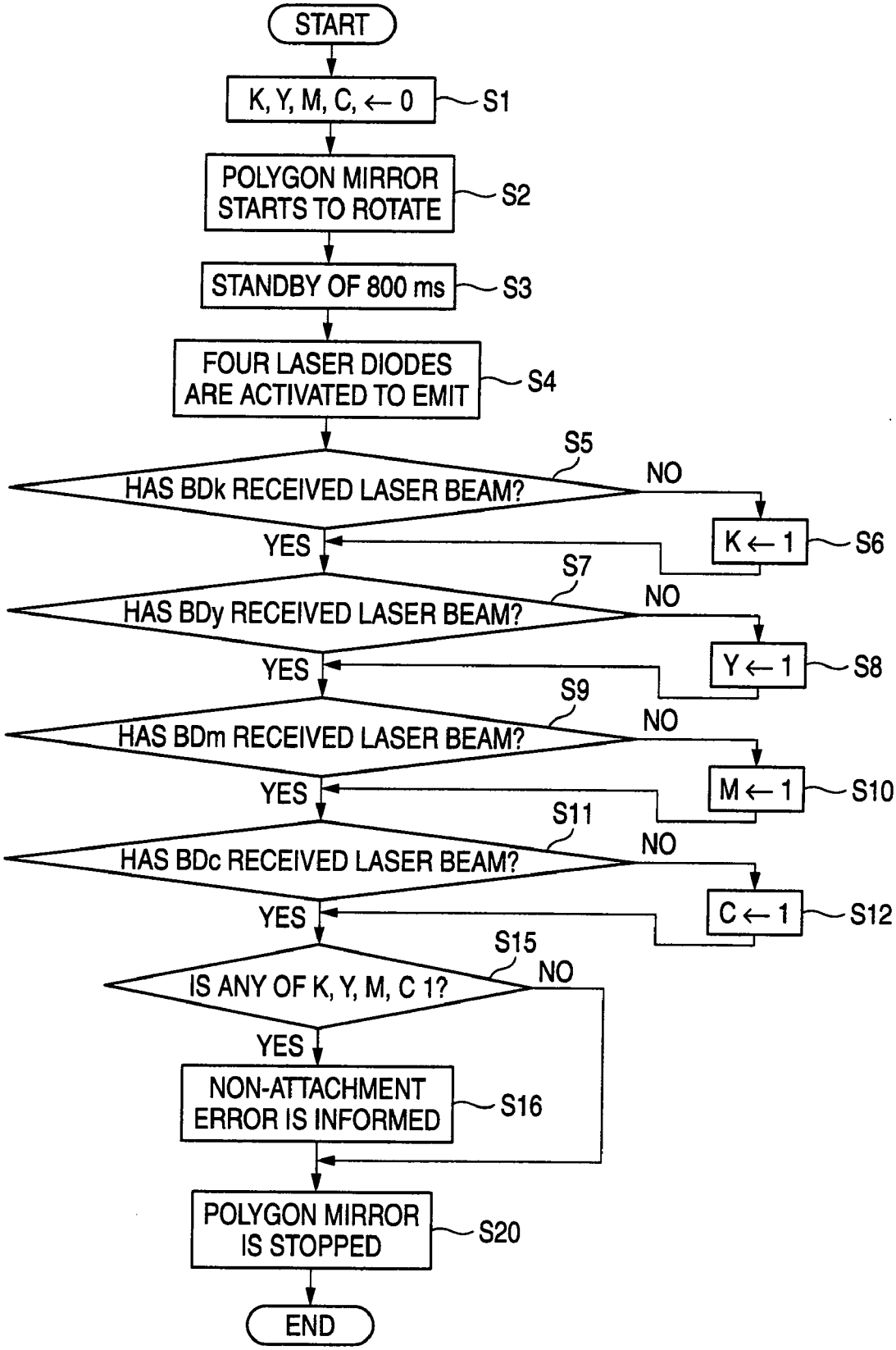
FIG. 6 is a flowchart showing a detection sequence operation in the control system.

As shown in FIG. 6, in this operation, firstly, in S1 (S denotes a step: this will be true in the following description), flags K, Y, M and C are reset. In S2 which follows S1, by a drive signal being sent to the polygon motor 403, the polygon mirror 402 starts to rotate, and in S3 which follows S2, a standby of 800 ms is executed until the polygon mirror 402 becomes stable. Then, when 800 ms has elapsed, the four laser diodes LDk, LDy, LDm, LDc are activated to emit light in S4 which follows S3.

In S5 which follows S4, it is determined whether or not the BD sensor BDk has received a black (K color) laser beam Lk. Then, if it is determined that the BD sensor BDk has received the laser beam Lk (S5: Y), the operation proceeds to S7, while if it is determined that the BD sensor BDk has not received the laser beam Lk (S5: N), the flag K is set to 1 in S6, and thereafter, the operation proceeds to S7. Namely, if the BD sensor BDk has not received the laser beam Lk (S5: N), there exists a possibility that the black process cartridge 500*k* has not attached in place in the drawer unit 560. The flag K is a flag which indicates such a state.

In operations from S7, similar operations will be executed with respect to yellow, magenta and cyan. Namely, in S7, it is determined whether or not the BD sensor BDy has received a yellow (Y color) laser beam Ly. Then, if it is determined that the BD sensor BDy has received the laser beam Ly (S7: Y), the operation proceeds to S9, while if it is determined that the BD sensor BDy has not received the laser beam Ly (S7: N), the flag Y is set to 1 in S8, and thereafter, the operation proceeds to S9. In S9, it is determined whether or not the BD sensor BDm has received a magenta (M color) laser beam Lm. Then, if it is determined that the BD sensor BDm has received the laser beam Lm (S9: Y), the operation proceeds to S11, while if it is determined that the BD sensor BDm has not received the laser beam Lm (S9: N), the flag M is set to 1 in S10, and thereafter, the operation proceeds to S11. In S11, it is determined whether or not the BD sensor BDc has received a cyan (C color) laser beam Lc. Then, if it is determined that the BD sensor BDc has received the laser beam Lc (S11: Y), the operation proceeds to S15, while if it is determined that the BD sensor BDc has not received the laser beam Lc (S11: N), the flag C is set to 1 in S12, and thereafter, the operation proceeds to S15.

In the operations, S5, S7, S9, S11 correspond to an example of a determination unit. In addition, although these operations may be implemented by storing changes in output signals from the respective BD sensors BD in the RAM 803, states of the flags may be held by a separate circuit such as a hard logic.

To follow, it is determined in S15 whether or not any of the flags K, Y, M, C is 1. If any of the flags K, Y, M, C is 1 (S15: Y), there exists a possibility that an uncompleted attachment of the process cartridge is taking place in which any of the process cartridges 500 has not been attached in place. Then, when such is the case, the operation proceeds to S16, which is an example of an uncompleted attachment informing unit, a non-attachment error, which is one of error flags, is informed, the operation proceeding to S20. When the non-attachment error is informed, an appropriate operation will be executed which includes the display of an error message on the display unit 810.

In S20 which follows S16, the polygon mirror 402 is stopped, and the operation ends temporarily. In addition, if all the flags K, Y, M, C are 0 (S15: N), the operation proceeds to S20 from S15, where the polygon mirror 402 is stopped, and the operation ends.

1.5 Advantage of First Exemplary Embodiment

In this way, in the first exemplary embodiment, by the BD sensors BDk, BDy, BDm, BDc being disposed on the corresponding process cartridges 500*k*, 500*y*, 500*m*, 500*c*, uncompleted attachment of the process cartridge can be detected. Namely, only by disposing the BD sensors BDk, BDy, BDm, BDc which are inevitable to form an electrostatic latent image on the respective photosensitive drums 510, uncompleted attachment of the process cartridge can be detected without increasing the number of component. Consequently, an appropriate action to cope with the uncompleted attachment of the process cartridge 500 can be executed which includes the display of an error message.

2. Second Exemplary Embodiment

Next, a laser printer 900 of a second exemplary embodiment will be described. Most components of the laser printer 900 are configured the same as those of the laser printer 100 that was described above. Therefore, in the following description, only different features will be described.

2.1 Configuration of Second Exemplary Embodiment

Figure 7:
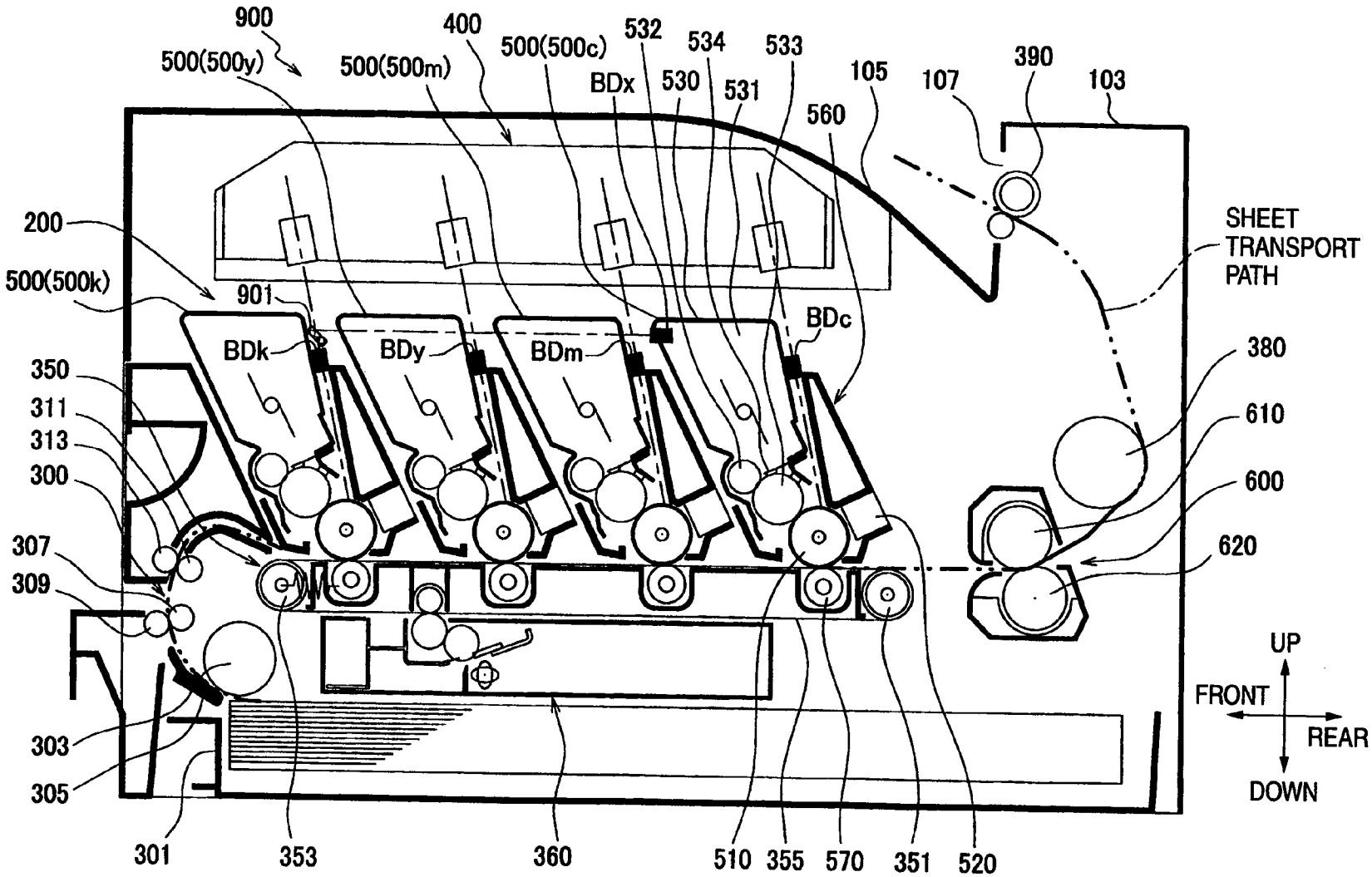
FIG. 7 is a side sectional view showing a schematic configuration of a laser printer of a second exemplary embodiment.
Figure 8:
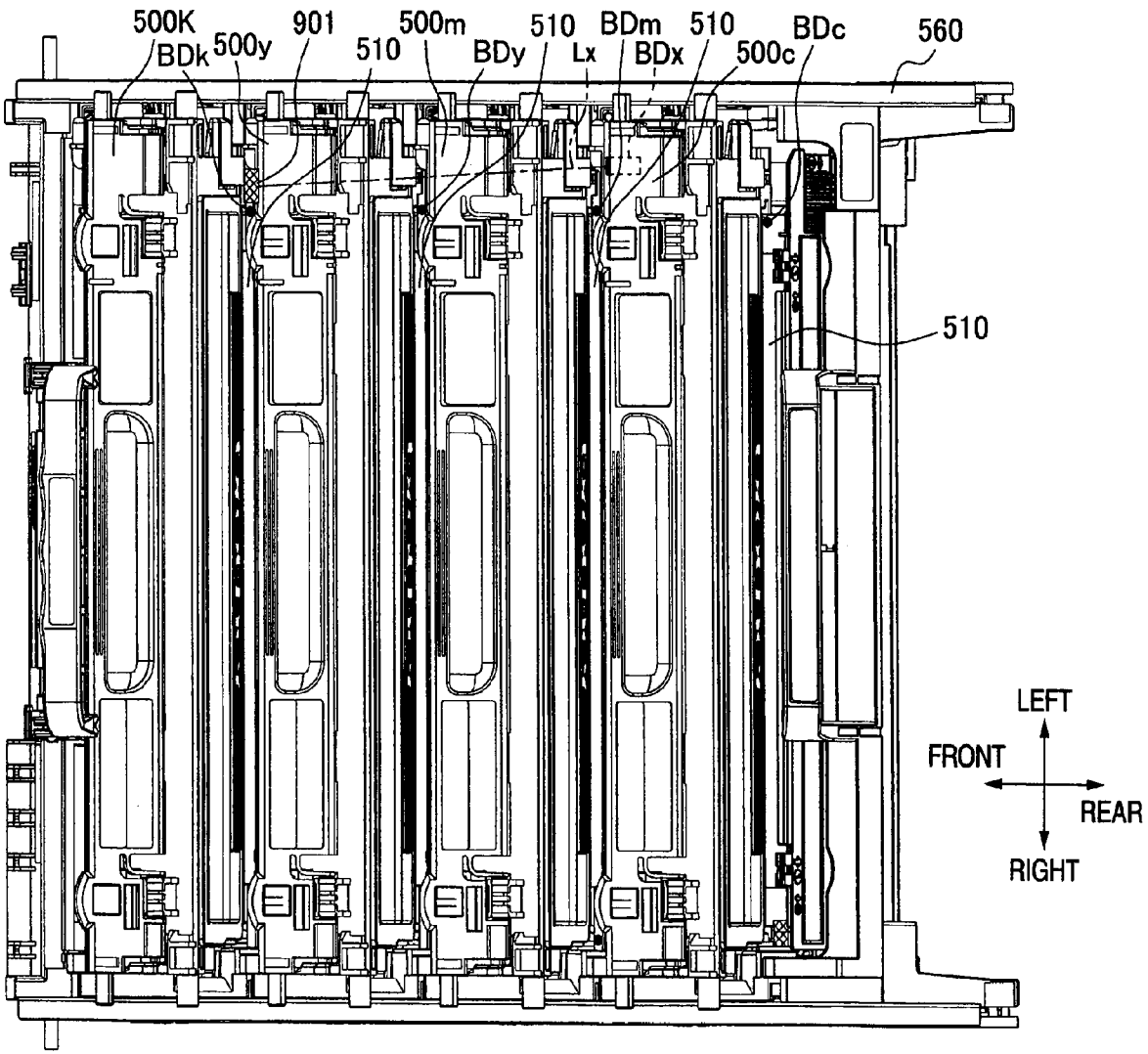
FIG. 8 is a plan view showing the configuration of process cartridges housed in a drawer unit of the laser printer.

As shown in FIGS. 7 and 8, in this exemplary embodiment, a mirror 901 is fixed to a left-hand side of an exposed portion of a photosensitive drum 510 for a black process cartridge 500*k*. This mirror 901 is provided within a range of an optical path of a laser beam Lk and in a position where the mirror 901 does not affect the formation of an electrostatic latent image on to the photosensitive drum 510 and the detection of laser beam Lk by the BD sensor BDk. In addition, since the mirror 901 is fixed to the process cartridge 510, the mirror 901 is attached to and detached from a drawer 560 together with the process cartridge 500*k*. In addition, a BD sensor BDx, which is provided for confirming the positions (order) of the process cartridges, is fixed to a front surface of a cyan process cartridge 500*c* (a surface which faces the process cartridge 500*k*). Hereinafter, Lx denotes a laser beam that is reflected by the mirror 901.

Figure 9:
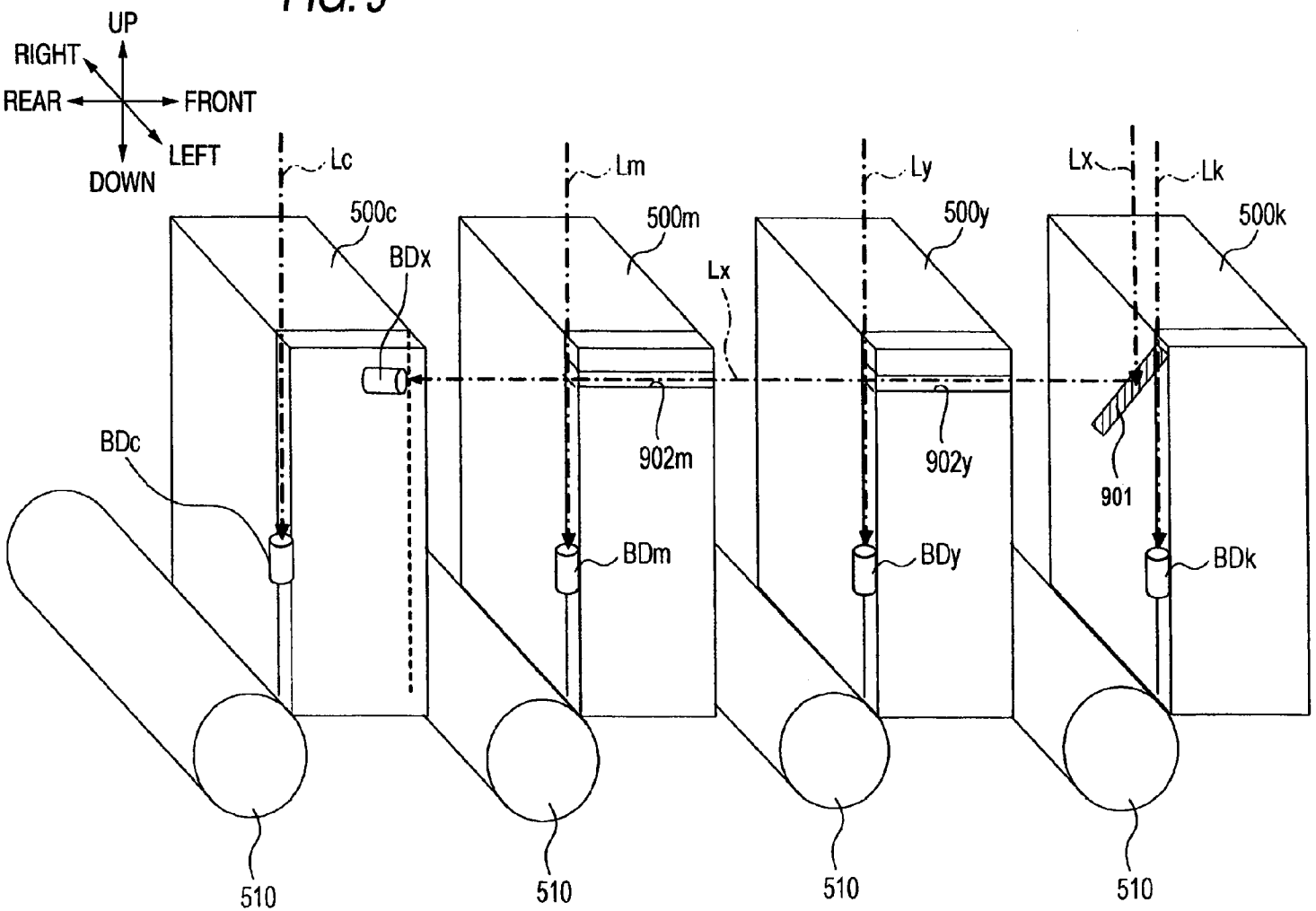
FIG. 9 is a perspective view showing exemplarily the configuration of the process cartridges.

Further, cavities 902*y*, 902*m* shown in FIG. 9, which are an example of an optical path member and a light transmission member which make a laser beam Lx reflected by the mirror 901 reach the BD sensor BDx, are provided on process cartridges 500*y*, 500*m*, respectively. Namely, as shown in FIG. 7, the mirror 901 and the BD sensor BDx are provided further upwards than the BD sensors BDk, BDy, BDm, BDc, which are an example of a second origin detection unit, and the cavities 902*y*, 902m, which are shown exemplarily in FIG. 9, are formed along a line which connects the mirror 901 and the BD sensor BDx.

Figure 10:
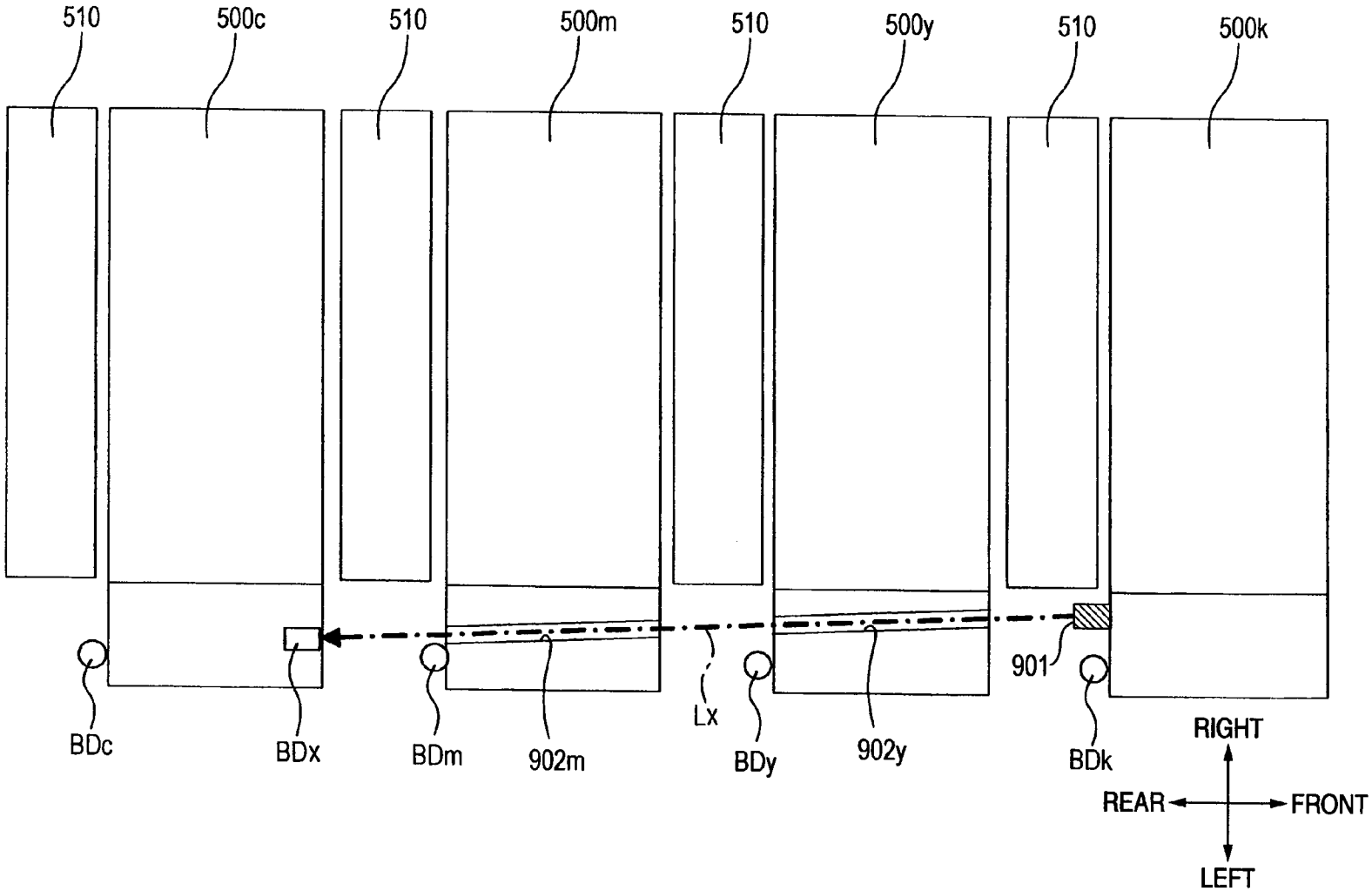
FIG. 10 is a plan view showing exemplarily the configuration of the process cartridges.

In addition, as shown exemplarily in FIG. 10, the line which connects the mirror 901 and the BD sensor BDx and the cavities 902*y*, 902*m* are provided along a direction which is inclined in a left-right direction with respect to a direction in which the process cartridges 500*k*, 500*y*, 500*m*, 500*c* are arranged. Because of this, unless all the process cartridges 500*k*, 500*y*, 500*m*, 500*c* are provided in their proper positions (proper order), the BD sensor BDx is not allowed to receive the laser beam Lx that is reflected by the mirror 901.

2.2 Controls and Advantage of Second Exemplary Embodiment

Figure 11:
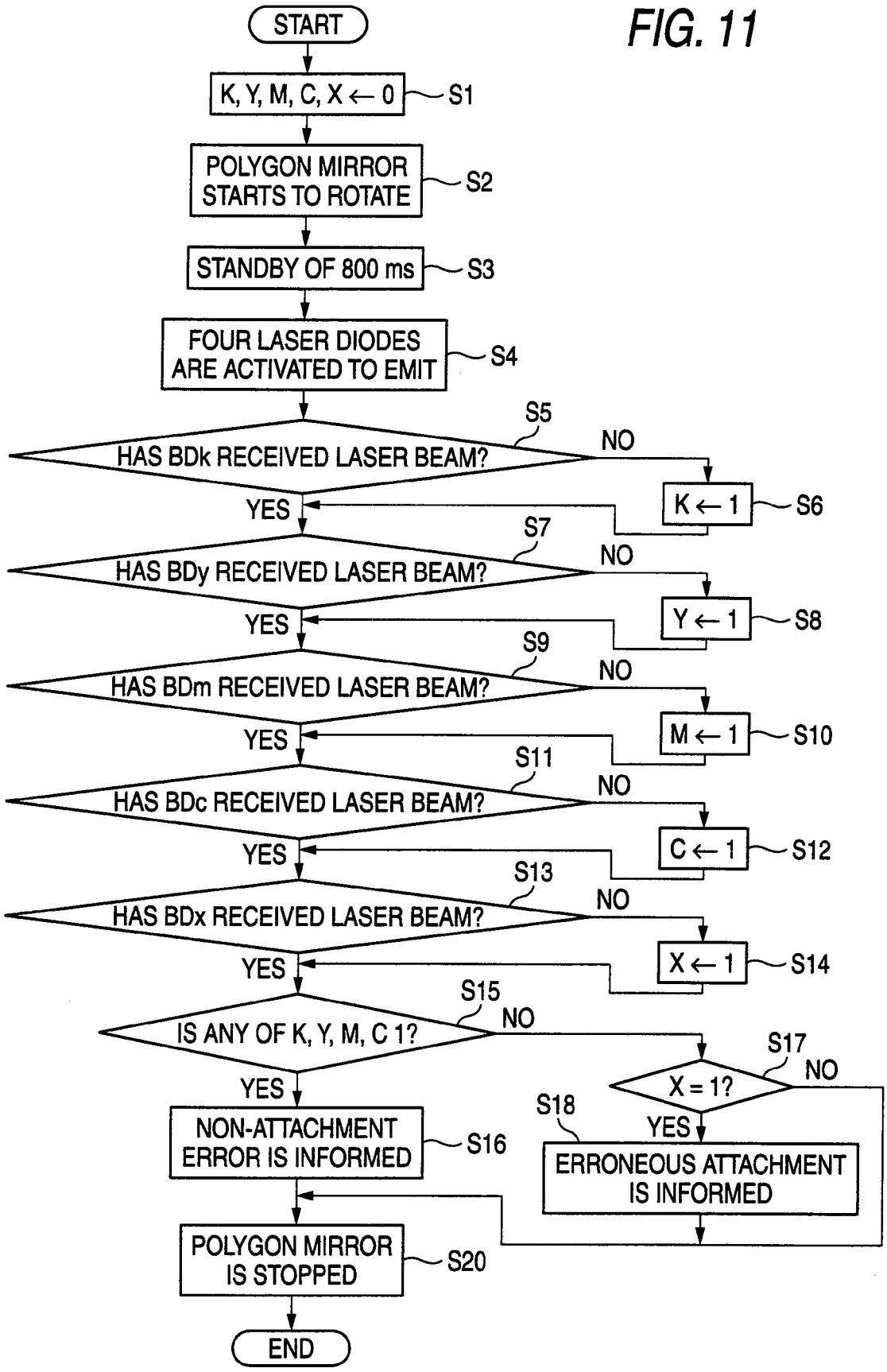
FIG. 11 is a flowchart showing a detection sequence operation of the second exemplary embodiment.

Then, in the second exemplary embodiment, the following controls become possible. FIG. 11 is a flowchart showing a detection sequence operation which is executed in a control unit 800 of the second exemplary embodiment. Note that this operation differs from the operation depicted in FIG. 6 in that operations in S13, S14, S17, S18 are inserted just before S20 and the remaining operations are configured the same as those depicted in FIG. 6.

In operations of S13 and S14, similar operations to S5 to S12 will be executed.

If it is determined in the S15 that any of flags K, Y, M, C is 1 (S15: Y), a non-attachment error is informed in S16, and thereafter, the operation proceeds to S20. If it is determined in the S15 that all the flags K, Y, M, C are 0 (S15: N), the operation proceeds to S17. In S17, it is determined whether or not flag X=1.

Since even if the process cartridges 500*k*, 500*y*, 500*m*, 500*c* are attached in a wrong order, the BD sensors BDk, BDy, BDm, BDc can receive laser beams Lk, Ly, Lm, Lc, therefore, the flags K, Y, M, C all become 0. However, if such an erroneous attachment takes place, the optical path made up of the cavities 902*y*, 902*m* is not formed, and the flag X becomes 1. Then, if flag X=1 in S17 (S17:Y), an erroneous attachment is informed in S18 which is an example of an erroneous attachment informing unit, and the operation proceeds to the aforesaid S20. When this attachment error is informed, an appropriate action is executed which includes the display of an error message on a display unit 810. On the other hand, if it is determined that the flag X is 0 (S17: N), the operation proceeds from S17 to S20.

In this way, in the second exemplary embodiment, only by providing BD sensor BDx and the mirror 901 in addition to the BD sensors BDk, BDy, BDm, BDc, the fact that all the process cartridges 500 are disposed in their proper positions can be detected with little increase in the number of components. Consequently, an appropriate operation which copes with the erroneous attachment of the process cartridges 500 can be executed without increasing the production cost of the image forming apparatus. In addition, in the second exemplary embodiment, since the BD sensors BDk, BDy, BDm, BD care provided on the process cartridges 500*k*, 500*y*, 500*m*, 500*c* as with the first exemplary embodiment, the uncompleted attachment thereof can also be detected properly.

3. Other Exemplary Embodiments

Figure 12:
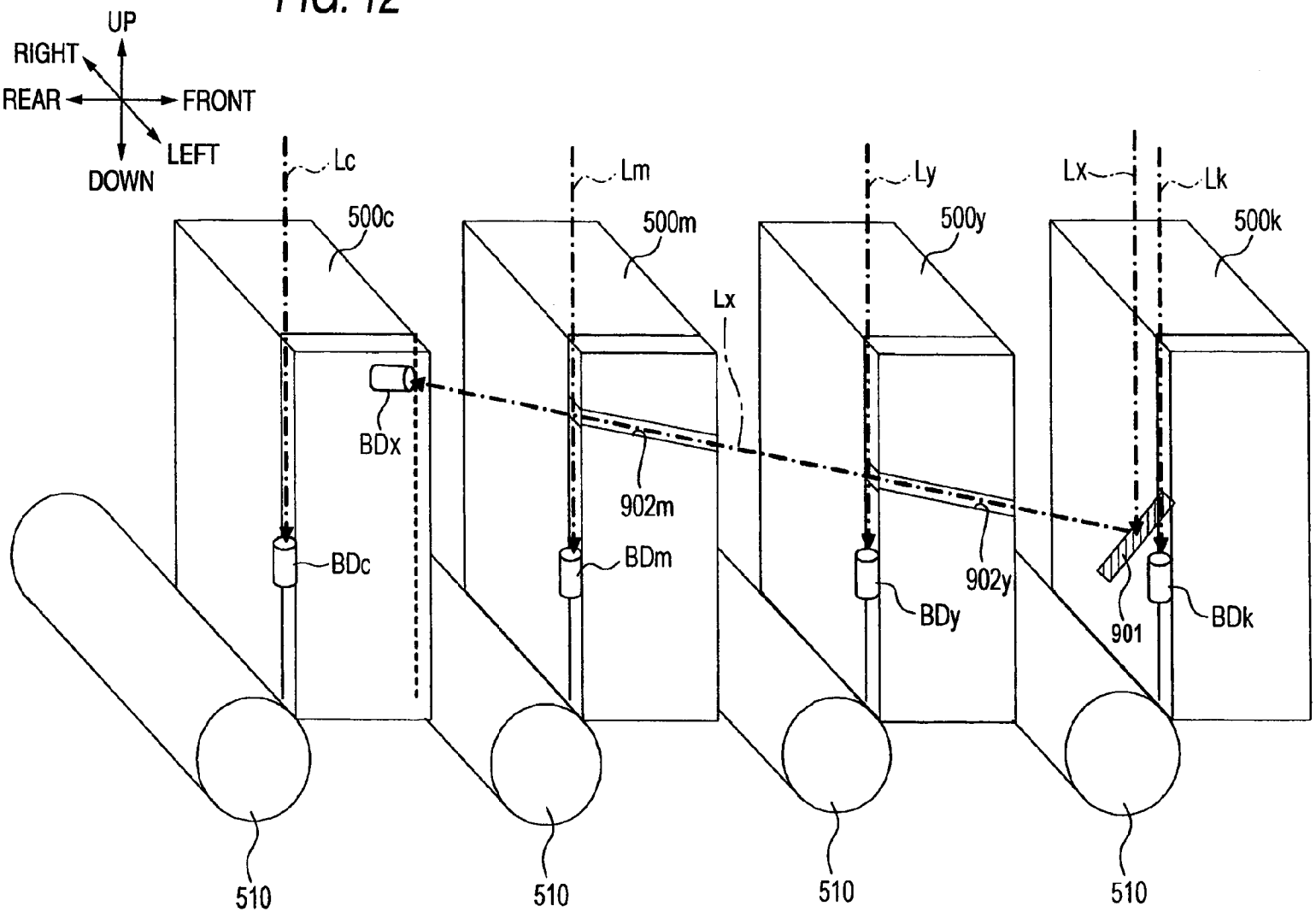
FIG. 12 is a perspective view showing exemplarily the configuration of a modified exemplary embodiment of the process cartridges.

The invention is not limited to the above described exemplary embodiments but can be modified variously without departing from the spirit and scope of the invention. For example, as is shown exemplarily in FIG. 12, the line which connects the mirror 901 and the BD sensor BDx and the cavities 902*y*, 902*m* may be provided along a direction which is inclined in an up-down direction with respect to the direction in which the process cartridges 500*k*, 500*y*, 500*m*, 500*c* are arranged. In addition, a cavity may also be provided on the process cartridge 500*c* and the BD sensor BDx which detects the laser beam Lx which is reflected by the mirror 901 may be provided on the drawer unit 560 or the housing 103.

As described above, according to the exemplary embodiments, there is provided an image forming apparatus for forming an image by forming an electrostatic latent image by scanning a laser beam in a main scanning direction to expose a photosensitive member, including a process cartridge holding the photosensitive member and adapted to develop the electrostatic latent image formed on a surface of the photosensitive member by causing toner to stick to the electrostatic image and an origin detection unit provided on the process cartridge within a range of an optical path of the laser beam and out of a range of an optical path of a laser beam for forming the electrostatic latent image for detecting the laser beam at a scanning origin of the scanning exposure.

In the image forming apparatus that is configured in the way described above, the process cartridge holds the photosensitive member which is scanned by the laser beam for exposure and develops the electrostatic latent image form on the surface thereof with toner. In addition, the origin detection unit for detecting the laser beam at the scanning origin of the scanning exposure is provided on the process cartridge. Because of this, it is found when the laser beam cannot be detected by the origin detection unit that the process cartridge has not possibly been attached yet.

Moreover, this origin detection unit is provided within the range of the optical path of the laser beam and out of the range of the optical path of the laser beam for forming the electrostatic latent image on the photosensitive member. Because of this, there is caused no problem in forming an image by disposition of the origin detection unit on the process cartridge.

In this way, in the image forming apparatus of the exemplary embodiments, the possibility of uncompleted attachment of the process cartridge can be detected only by changing the arrangement of the origin detection unit which has conventionally be considered as inevitable without increasing the number of components. Consequently, an appropriate action can be taken to cope with the uncompleted attachment of the process cartridge without increasing the production cost of the image forming apparatus.

In addition, although not limited to the following configuration, the image forming apparatus according to the exemplary embodiments may include further a determination unit for determining whether or not the origin detection unit has detected the laser beam, and an uncompleted attachment informing unit for informing of uncompleted attachment of the process cartridge when the determination unit determines that the origin detection unit has not detected the laser beam yet. As this occurs, when it is detected via the origin detection unit that there exists the possibility of uncompleted attachment of the process cartridge, information to that effect can be given via the uncompleted attachment informing unit.

Additionally, according to the exemplary embodiments, there is provided an image forming apparatus for forming an image by forming electrostatic latent images by emitting individually laser beams to a plurality of photosensitive members and scanning individually the plurality of photosensitive members by the respective laser beams to expose the plurality of photosensitive members, including a plurality of process cartridges holding individually the respective photosensitive members and adapted to develop the electrostatic latent images formed on surfaces of the photosensitive members by causing toner to stick to the electrostatic latent images, a reflection mirror provided on at least one process cartridge of the plurality of process cartridges in a position lying within a range of an optical path of the laser beam for the one process cartridge and out of a range of an optical path of a laser beam for forming the electrostatic latent image on the photosensitive member of the one process cartridge for reflecting the laser beam, a first origin detection unit for detecting a laser beam reflected by the mirror, and an optical path member provided on the process cartridges other than the process cartridge on which the mirror is provided of the plurality of process cartridges and extending from the mirror to the first origin detection unit when all the process cartridges disposed in their proper positions.

In the image forming apparatus of the exemplary embodiments that is configured in the way described above, the respective process cartridges hold individually the photosensitive members which are scanned by the laser beams for exposure and develop the electrostatic latent images formed on the respective surfaces of the photosensitive members. In addition, the mirror is provided on at least the one process cartridge of the process cartridges in the following position. Namely, this mirror is provided in the position lying within the range of the optical path of the laser beam for the one process cartridge and out of the range of the optical path of the laser beam for forming the electrostatic latent image on the photosensitive member of the one process cartridge. Because of this, there is caused no problem in image formation by the provision of the mirror on the one process cartridge.

In addition, when all the process cartridges are disposed in their proper positions, the laser beam that is reflected by the mirror passes through the optical path provided on the process cartridges other than the process cartridge on which the mirror is provided and then reaches the first origin detection unit from the mirror. The first origin detection means detects the laser beam that has been reflected by the mirror, and it is found when the laser beam is detected in the way described above that all the process cartridges are disposed in their proper positions. In addition, when the first origin detection unit detects the laser beam, the scanning origin relative to the process cartridge on which the mirror is provided can be set by the timing at which the laser beam is so detected.

In this way, in the image forming of the exemplary embodiments, it becomes possible to detect that all the process cartridges are disposed in their proper positions with little increase in the number of components only by changing the arrangement of the origin detection unit that has conventionally been considered as inevitable and providing the mirror. Consequently, an appropriate action can be executed to cope with an erroneous attachment of the process cartridges.

In addition, although not limited to the following configuration, the image forming apparatus according to the exemplary embodiments may be such that the plurality of process cartridges are disposed so as to be aligned in parallel, that the mirror is provided on the process cartridge which is disposed at one end of the array of process cartridges, while the first origin detection unit is provided on the process cartridge which is disposed at the other end of the array of process cartridges, and that the optical path member is a light transmission member which is provided on all the process cartridges except for the process cartridges which are disposed at both the ends of the array of process cartridges and which extends along a direction which intersects the direction in which the respective process cartridges are arranged when all the process cartridges except for the process cartridges at both the ends of the array of process cartridges are disposed in their proper positions. As this occurs, since the light transmission member as the optical path member is provided on all the process cartridges except for the process cartridges disposed at both the ends of the array of process cartridges along the direction in which the process cartridges are arranged, the erroneous attachment of the process cartridges can be detected by the simple configuration in an ensured fashion.

Additionally, the image forming apparatus according to the aspect of the invention may comprise further a plurality of second origin detection units provided on all the process cartridges other than the process cartridge on which the mirror is provided of the plurality of process cartridges for detecting the laser beams at scanning origins of the scanning exposures which lie within ranges of optical paths of the laser beams for the process cartridges other than the process cartridge on which the mirror is provided and out of ranges of optical paths of laser beams for forming the electrostatic latent images on the photosensitive members of the process cartridges other than the process cartridge on which the mirror is provided.

According to the above, the second origin detection units for detecting the laser beams at the scanning origins of the scanning exposure are provided individually on the process cartridges on which the mirror is not provided. Because of this, it is found when the laser beams can be detected by the second origin detection units that the process cartridges on which the second origin detection units are provided are attached in place. Moreover, the second origin detection units are provided within the ranges of the optical paths of the laser beams and out of the ranges of the optical paths of the laser beams for forming the electrostatic latent images on the photosensitive members on which the mirror is not provided. Because of this, there is caused no problem in image formation by disposing the second origin detection units on the process cartridges on which the mirror is not provided. Consequently, in this case, the fact that all the process cartridges are attached in place can be detected in an ensured fashion.

In addition, the image forming apparatus according to the exemplary embodiments include further a first determination unit for, when a laser beam is emitted towards the process cartridge on which the mirror is provided, determining whether or not the first origin detection unit has detected the laser beam, a second determination unit for, when laser beams are emitted towards the process cartridges on which the mirror is not provided, determining whether or not the second origin detection units have detected the laser beams, and an attachment error informing unit for informing of an attachment error of the process cartridges when the first determination unit determines that the first origin detection unit has not detected the laser beam yet and the second determination unit determines that all the second origin detection units have detected the laser beams.

Namely, in the event that the image forming apparatus include the first origin detection unit and the second origin detection units, when the first determination unit determines that the first origin detection unit has not detected the laser beam yet and the second determination unit determines that all the second origin detection units detect the laser beams, although this verifies that all the process cartridges are now attached to the image forming apparatus, it is highly possible that the process cartridges are disposed erroneously. Then, in the event that such is the case, the erroneous attachment informing unit informs that the process cartridges are attached erroneously. Consequently, in the case of such an erroneous attachment of the process cartridges, when it is detected that there exists a possibility of erroneous attachment of the process cartridges, information to that effect can be given.

What is claimed is:

1. An image forming apparatus comprising:

a plurality of process cartridges, each of the process cartridges holding a photosensitive member on which an electrostatic latent image is configured to be formed, each of the process cartridges configured to develop the electrostatic latent image by supplying toner to the electrostatic latent image;

an image forming unit which is configured to scan a laser beam in a main scanning direction to expose a respective one of the photosensitive members, and which is configured to form the electrostatic latent image on the respective one of the photosensitive members to form an image;

a mirror that is provided on at least one of the process cartridges in a position lying within a range of an optical path of the laser beam for the one process cartridge and out of a range of an optical path of the laser beam for forming the electrostatic latent image on the photosensitive member of the one process cartridge, the mirror is provided for reflecting the laser beam;

a first origin detection unit that is configured to detect the laser beam reflected by the mirror; and an optical path member that is provided in the process cartridges other than the process cartridge on which the mirror is provided, the optical path member extending from the mirror to the first origin detection unit when all the process cartridges are mounted in respective predetermined positions.

2. The image forming apparatus according to claim 1, wherein the plurality of process cartridges are disposed in parallel, the mirror is provided on the process cartridge which is disposed at one end side of the process cartridges, and the first origin detection unit is provided on the process cartridge which is disposed at the other end side of the process cartridges, and wherein the optical path member is a light transmission member which is provided in all the process cartridges except for the process cartridges which are disposed at the end sides of the process cartridges, the optical path member extending along a direction which intersects a direction in which the process cartridges are disposed when all the process cartridges except for the process cartridges of the end sides of process cartridges are disposed in the predetermined positions, respectively.

3. The image forming apparatus according to claim 2, further comprising:

a plurality of second origin detection units provided on all the process cartridges other than the process cartridge on which the mirror is provided, each of the second origin detection units is disposed in a position lying within a range of an optical path of the laser beam and out of a range of an optical path of the laser beam for forming the electrostatic latent image, each of the second origin detection units configured to detect an origin of the laser beam for scanning and exposing.

4. The image forming apparatus according to claim 3, further comprising:

a processing unit;

memory having instructions stored thereon that, when executed, cause the processing unit to provide a first determination unit that is configured, when the laser beam is emitted towards the process cartridge on which the mirror is provided, to determine whether the first origin detection unit detects the laser beam;

a second determination unit that is configured, when the laser beams are emitted towards the process cartridges on which the mirror is not provided, to determine whether the second origin detection units detect the laser beams; and an attachment error informing unit that is configured to inform of an attachment error of the process cartridges when the first determination unit determines that the first origin detection unit does not detect the laser beam and the second determination unit determines that all the second origin detection units detect the laser beams.

* * * * *